United States Patent [19]

Weiss

[11] Patent Number: 4,713,998

[45] Date of Patent: Dec. 22, 1987

[54] BOW FROG

[76] Inventor: Sidney Weiss, 331 N. Lucerne Blvd., Los Angeles, Calif. 90004

[21] Appl. No.: 30,331

[22] Filed: Mar. 26, 1987

[51] Int. Cl.[4] ..... G10D 3/16

[52] U.S. Cl. ..... 84/282

[58] Field of Search ..... 84/282

[56] References Cited

U.S. PATENT DOCUMENTS

| | | | |
|---|---|---|---|
| 676,028 | 6/1901 | Conklin | 84/282 |
| 1,461,096 | 7/1923 | Rigg | 84/282 |

*Primary Examiner*—Lawrence R. Franklin

*Attorney, Agent, or Firm*—Marvin E. Jacobs

[57] ABSTRACT

A novel bow frog formed with a base portion, an aperture extending transversely through said base portion, a cylinder rotatably positioned within said aperture having means located generally centrally of said cylinder for rotating said cylinder within said aperture to wind said hair band onto or off of said cylinder to adjust the tension of said hair band, and means for releasably locking said cylinder in a desired position within said aperture.

5 Claims, 4 Drawing Figures

BOW FROG

BACKGROUND OF THE INVENTION

This invention relates to bows for use on resonating wood instruments such as violins, violas, cellos and the like and, more particularly, to a frog which can be readily adjusted by the player to provide optimum tension of the hair under any conditions.

Though most understand that a violin is a finely crafted and expensive instrument, the quality and adjustment of the bow also contributes to the quality of the sound generated by moving the hair of the bow across the strings of the violin. Bows can be formed of a bent, flexible, piece of metal or wood. Fine bows are formed of a bent wood having a length of hair attached between the head of the bow and a rear fixture known as a frog.

The length of hair is fixed and is set by a repairman at his shop. The hair is sensitive to tension, temperature and humidity. To avoid unnecessary stretching of the hair, the frog is removed from the base of the bow between performances to relieve tension on the hair. In the modern era, concerts are performed under widely varying environments. In the same locale, a concert could be performed indoors in a heated or air conditioned hall or outside in an open bowl under hot and dry conditions during the day or cold, humid conditions at night. The conditions further change from season to season, week to week and city to city.

The length of the hair on the bow will change as the hair experience different humidities and temperatures. The length will also change with use due to tension forces during playing. The hair can even lengthen excessively during a concert forcing a change of bows at intermission. Since the hair is set to an exact length at the shop of the repairman, a concert violinist is required to own a plurality of bows and has to equip them with different lengths of hair for different conditions. If the hair has been shortened for use under high temperature and humidity conditions, it will be too short to use when the temperature is lower requiring a very expensive replacement of the hair. Furthermore, the repairman and the musician are constantly guessing at the exact length to cut the hair. For example, a Los Angeles repairman preparing a bow to be used in Seattle has a very difficult problem of predicting the weather and estimating the length to cut the hair. This is a common situation since many performers trust only a single dealer or repairman who may be thousands of miles away. Unfortunately, the bow is rarely adjusted exactly and the musician has to perform under non-ideal conditions.

DESCRIPTION OF THE PRIOR ART

Violin and bow makers have long been aware of this problem and several devices for adjusting the hair have been proposed. However, most of these devices required alteration of the stick. One device required adhering a piece of wood to the stick of the bow with glue. The frog was adjustably clamped to the piece of wood. This device did not work. Other devices also required modification of the bow by drilling holes in the stick. Fine bows can cost over $25,000.00 and musicians would not permanently alter a bow with such devices.

Several bow frogs which include means for adjusting the length of the hair are disclosed in the patent literature.

Several patents show adjustment of the length of the hair by means of a bolt or screw device extending from the rear of the frog and connected to the hair anchoring means. For example, Rigg (U.S. Pat. No. 1,427,851) tensions hair by means of an anchor screw 30 and Nathan (U.S. Pat. No. 2,479,505) adjusts the length of a slidable frog by means of a thrust screw. Fox-Adams (British Pat. No. 16,769) tensions hair by means of a lid hinged to the frog which contained pillars engaging notches on a comb-like structure. Franklin, et al. (U.S. Pat. No. 320,123) changed the length of the hair by pulling or slackening the hair within a clamping device operated by means of an eccentric roller connected to a lever. The hair is held between two cushioned plates.

Other patents are of general interest only. Heddon (U.S. Pat. No. 2,252,929) and Woerner (U.S. Pat. No. 2,263,793) disclose steel bows. Nebel (U.S. Pat. No. 2,258,998) shows a replaceable string unit. Brown (U.S. Pat. No. 2,483,486) shows a keyed socket with a dovetail for slide mount of a frog. Straton (U.S. Pat. No. 2,492,017) discloses a spring metal hair-engaging clip which is mounted by friction within a frog block.

STATEMENT OF THE INVENTION

A novel frog is provided in accordance with the invention which permits adjustment of the length of the hair by the musician over a range of lengths. The length of the hair can be precisely adjusted at any time to provide an optimum length for any given environmental condition.

A musician need only have a single bow and can have that bow provided with a hair which will serve for all performance conditions. This will same time and expense to the musician while providing an optimum bow instrument at all times and for all performances. The violin repair technician need not guess at any exact length but need only provide an average length of hair since fine adjustment is provided by the adjustability of the invention. Even slight elongation of the hair experienced during performance can be accommodated by adjusting the hair during intermission.

The frog of the invention is readily manufactured and does not require any modification of the bow. The frog can be fitted to any conventional bow to replace the existing frog. It does not affect resonance or other acoustical quality of the bow. The frog of the invention has been tested on a bow for long concerts under varying conditions and has been found to be reliable, precise and convenient to use.

The frog of the invention includes a rotatable cylinder having a recess for receiving the end of the hair, means for rotating the cylinder and locking means for securing the cylinder in a set position. The frog can contain the conventional base-shoe for attachment to a bow and a wedge for spreading the hair band.

The preferred configuration for the frog comprises a base portion, an aperture extending transversely through said base portion, a cylinder or spool rotatably positioned within said aperture having means located generally centrally of said spool for releasably retaining the knotted end of a hair band, means for rotating said cylinder within said aperture to wind said hair band onto or off of said cylinder to adjust the tension of said hair band, and means for releasably locking said cylinder in a desired position within said aperture.

These and many other features and attendant advantages of the present invention will become apparent as the invention becomes better understood by reference to the following detailed description when considered in conjunction with the figures of the accompanying drawing.

DETAILED DESCRIPTION OF INVENTION

Figure 1:
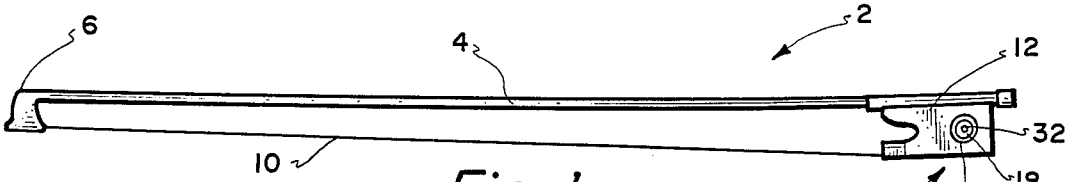
FIG. 1 is a side view of an instrument bow embodying the present invention.

FIG. 1 shows a bow, indicated generally at 2, comprising a flexible rod 4 having one end formed into a head 6 and a frog 8 mounted adjacent the opposite end of the rod 4. A hair band 10 is stretched tautly between the head 5 and the frog 8. In prior art instrument bows, the frog is adjustably mounted on the rod by suitable means and, if desired, the frog 8 of the present invention may be adjustably mounted on the rod 4 in a similar manner. However, this manner of adjustment is well known in the prior art and does not form a part of the present invention.

Figure 2:
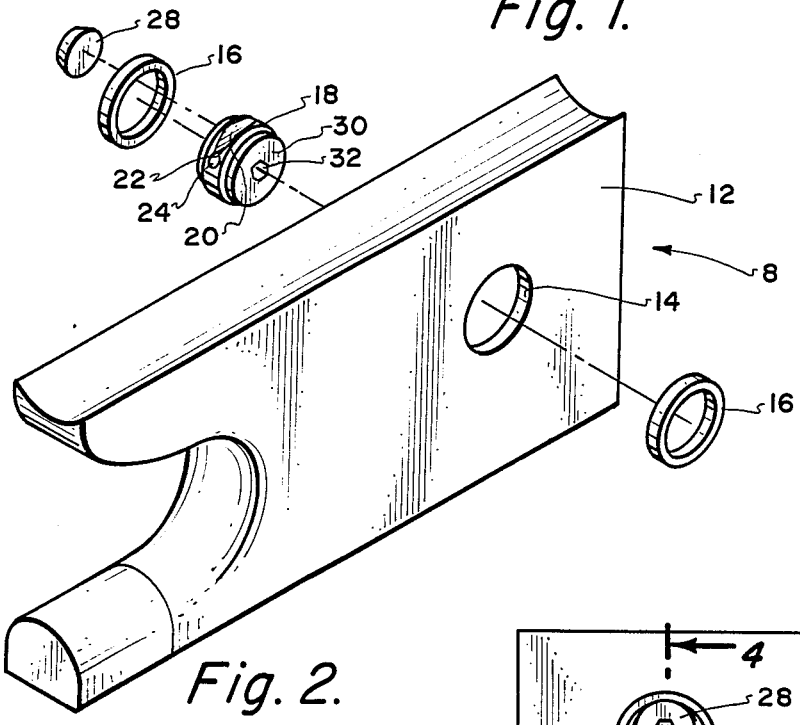
FIG. 2 is an exploded view of the frog of the instrument bow of FIG. 1.
Figure 3:
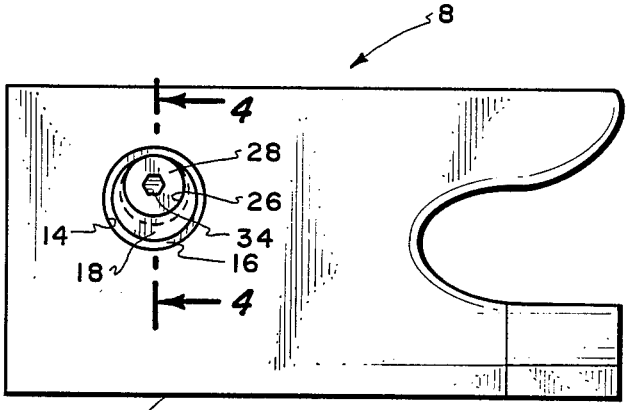
FIG. 3 is a side view of the frog of FIG. 2 showing the locking means therefor.
Figure 4:
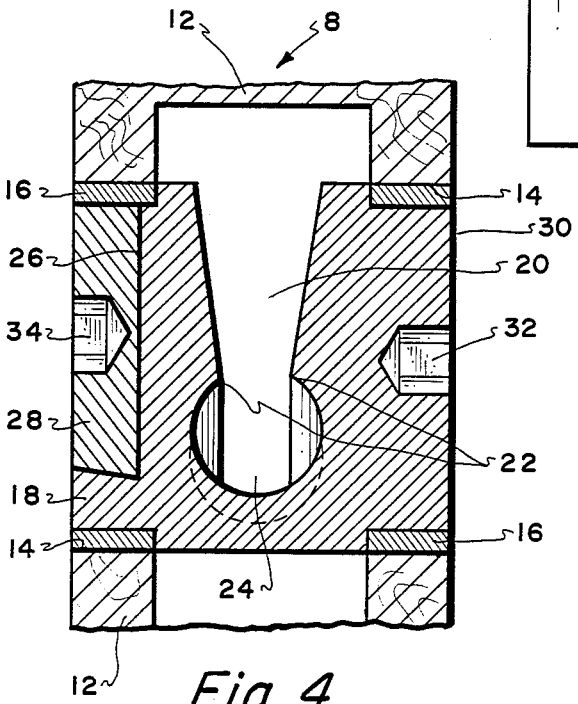
FIG. 4 is a view taken on line 4—4 of FIG. 3.

As best seen in FIGS. 2 and 4, the frog 8 of the present invention comprises a base portion 12 which is formed generally in a conventional manner but is provided with a transverse aperture 14 extending therethrough. A pair of ferrules 16 are mounted within the aperture 14 adjacent the respective ends thereof and serve to rotatably support a cylinder or spool 18. The cylinder 18 is formed with a central recess 20 transverse to the axis of the cylinder and the edges of the recess 20 come together, as seen at 22, to form a slot or notch 24 for releasably retaining the knotted end of the hair band 10. A further recess 26 is formed in one end of the cylinder 18 adjacent the periphery thereof to receive suitable locking means, such as cam lock 28. The other end 30 of the cylinder 18 is provided with a slot 32 for an Allen wrench to permit rotation of the cylinder 18 by means of an Allen wrench or the like. As seen in FIG. 3, the cam lock 28 is provided with a similar slot 34 to permit Allen wrench tightening and loosening of the cam lock 28.

In use, hair enters the frog 8 in the normal way, is then placed in slot 24 in the cylindrical spool 18 with the cam lock 28 loose. The spool 18 is turned counter-clockwise with an Allen wrench, winding the hair around the spool 18. When the hair is taut, the cam lock 28 is tightened clockwise to hold the spool 18 in place. The frog 8 is then operated in the normal way.

If, due to excessive humidity, the hair becomes too long, the cam lock 28 is loosened, turning counter-clockwise, and the spool 18 is turned counter-clockwise, rolling up the hair as needed. The cam lock 28 is then tightened securely clockwise, and the bow is ready. If, due to excessive dryness, the hair is too short, the cam lock 28 is loosened and the spool is tightened slightly, allowing the hair to pull out of the frog. Pressure with the thumb on the hair can aid in releasing the hair from the frog 8. Then the cam lock 28 is again tightened clockwise into the locked position.

The frog of the invention can be formed of any rigid engineering material such as metal, plastic or reinforced plastic. Metal parts are preferred since metal can be manufactured to close tolerance providing precise tension control and long and reliable service. The frog of the invention can be utilized on any flexible bow whether made of wood or metal.

It is to be understood that only preferred embodiments of the invention have been described and that numerous substitutions, modifications and alterations are permissible without departing from the spirit and scope of the invention as defined in the following claims.

I claim:

1. A frog for musical instruments comprising a base portion, an aperture extending transversely through said base portion, a cylinder rotatably positioned within said aperture having means located generally centrally of said cylinder for releasably retaining the knotted end of a hair band, means for rotating said cylinder within said aperture to wind said hair band onto or off of said cylinder to adjust the tension of said hair band, and means of releasably locking said cylinder in a desired position within said aperture.

2. The frog of claim 1 wherein:

said means for rotating said cylinder is a slot formed in one end of said cylinder.

3. The frog of claim 1 wherein:

said releasably locking means is a cam lock.

4. The frog of claim 3 wherein:

said cam lock is mounted in a recess formed in one end of said cylinder adjacent the periphery of said cylinder.

5. The frog of claim 1 wherein:

said means for releasably retaining the knotted end of said hair band comprises a recess formed in said cylinder having the edges thereof coming together to form a notch.

* * * * *